United States Patent [19]

Sevensson

[11] 4,238,221

[45] Dec. 9, 1980

[54] PROCESS FOR PREPARING IRON BASED POWDER FOR POWDER METALLURGICAL MANUFACTURING OF PRECISION COMPONENTS

[75] Inventor: Lars-Erik Sevensson, Hoganas, Sweden

[73] Assignee: Hoganas AB, Hoganas, Sweden

[21] Appl. No.: 36,838

[22] Filed: May 7, 1979

[51] Int. Cl.[2] ..... B22F 1/02

[52] U.S. Cl. ..... 75/0.5 BA; 148/126

[58] Field of Search ..... 75/0.5 R, 0.5 AB, 212; 148/126

[56] References Cited

U.S. PATENT DOCUMENTS

| | | | |
|---|---|---|---|
| 2,754,194 | 7/1956 | Graham et al. | 75/0.5 BA |
| 3,583,864 | 6/1971 | Adler | 75/0.5 BA |
| 3,853,572 | 12/1974 | Herron et al. | 75/0.5 BA |
| 3,901,661 | 8/1975 | Kondo et al. | 75/0.5 BA |

FOREIGN PATENT DOCUMENTS

| | | | |
|---|---|---|---|
| 1077990 | 8/1967 | United Kingdom | 75/212 |

*Primary Examiner*—M. J. Andrews

*Attorney, Agent, or Firm*—Eugene E. Renz, Jr.

[57] ABSTRACT

A process for manufacturing iron-based powder to be used for powder metallurgical manufacturing of precision components having good accuracy to size and high strength. In accordance with the process, a mixture of substantially only iron powder and an alloying powder of copper and/or reducible copper compounds is prepared. The mixture is then subjected to annealing treatment in a reducing atmosphere at a temperature between 700° C. and 950° C. for a period of 15 minutes to 10 hours. Preferably the time period is 0.5 to 5 hours. The alloying powder is adhered to the iron powder by diffusion. The cake thus obtained is ground to an iron powder diffusion alloyed with copper and the copper alloyed iron powder thus obtained is mixed with pure iron powder in such an amount that the mixture obtains the intended copper content.

9 Claims, 5 Drawing Figures

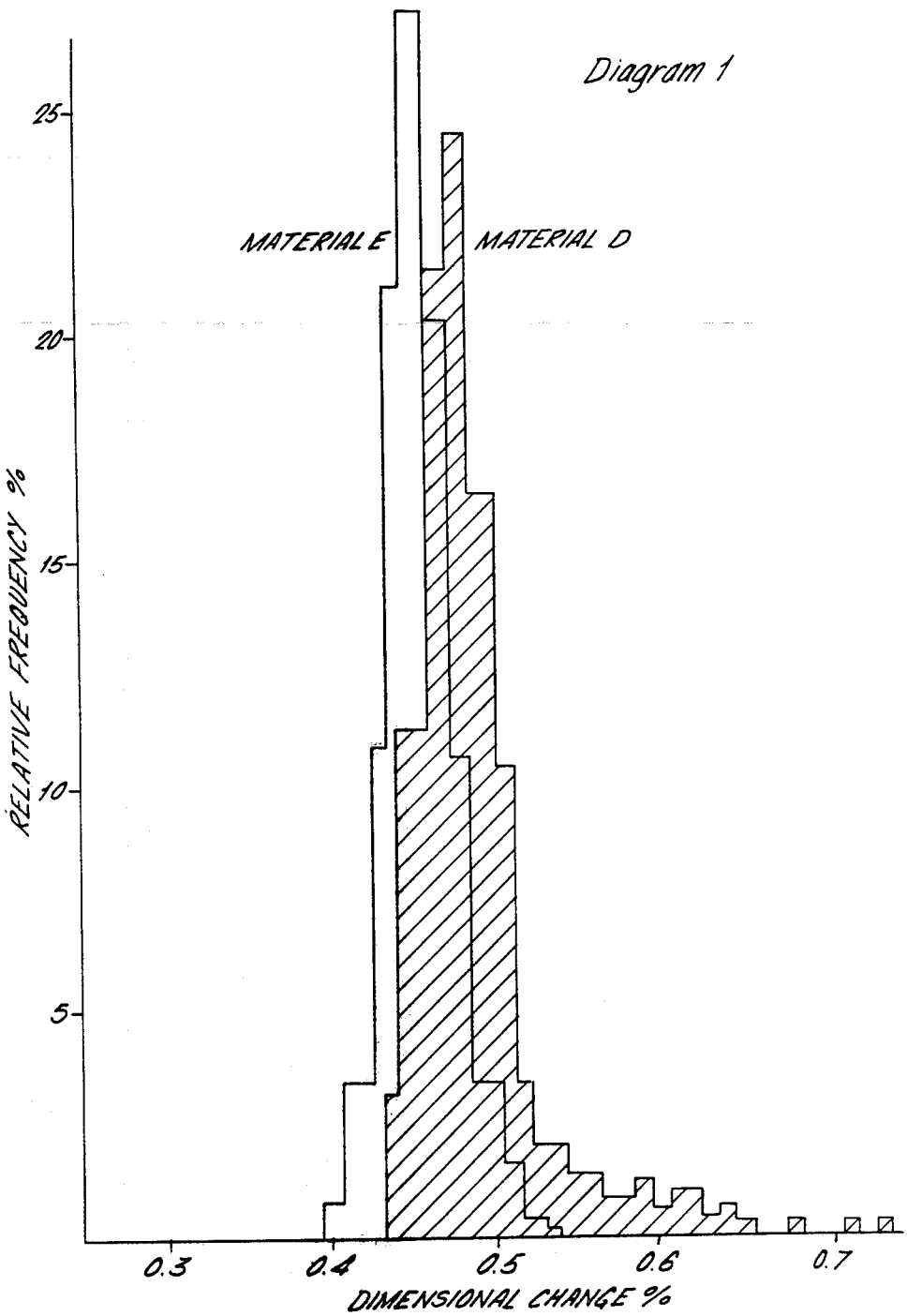
Diagram 1
MATERIAL E
MATERIAL D
RELATIVE FREQUENCY %
25
20
15
10
5
0.3
0.4
0.5
0.6
0.7
DIMENSIONAL CHANGE %

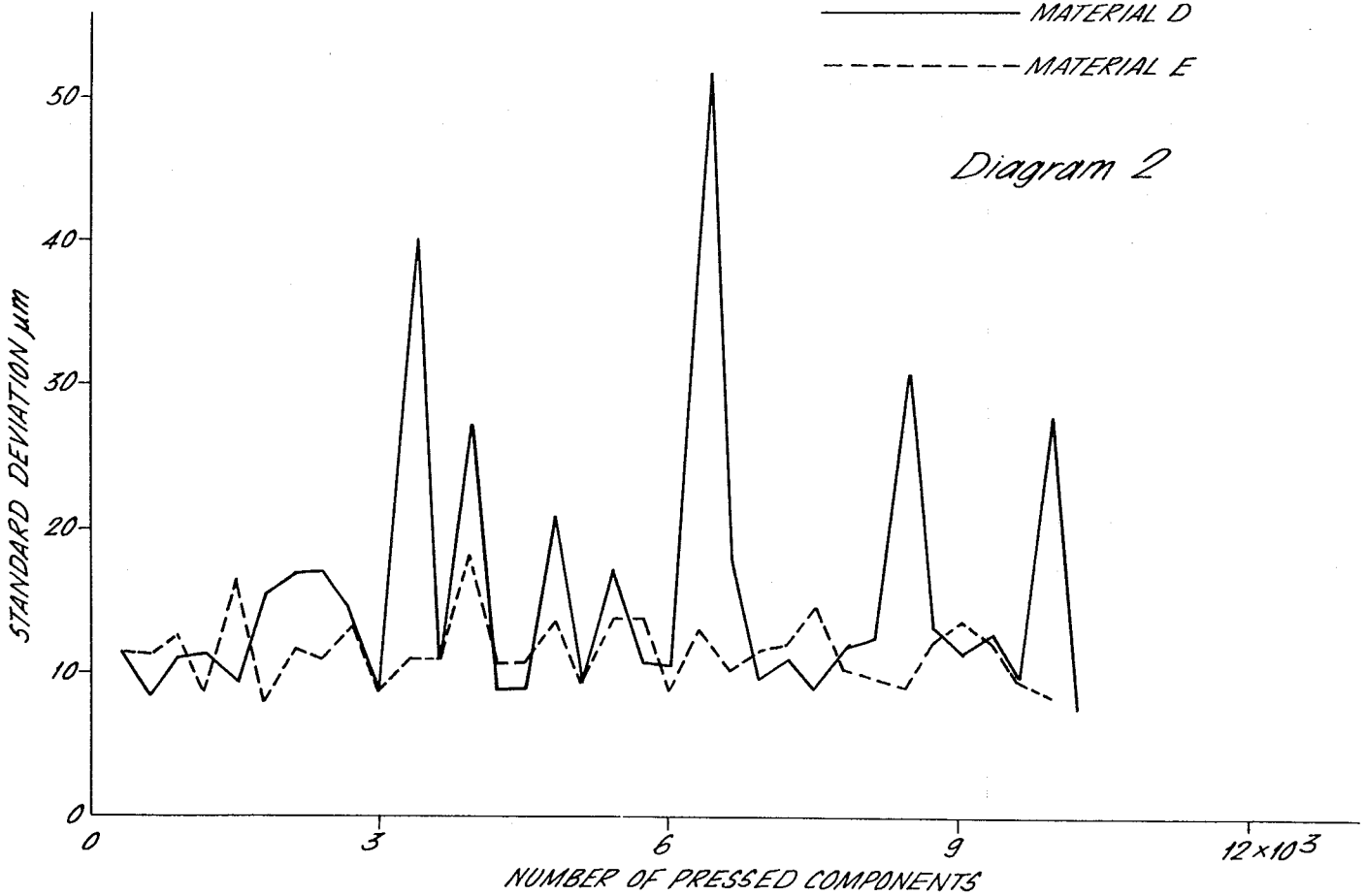
MATERIAL D
MATERIAL E
Diagram 2
STANDARD DEVIATION μm
50
40
30
20
10
0
0
3
6
9
12×10³
NUMBER OF PRESSED COMPONENTS

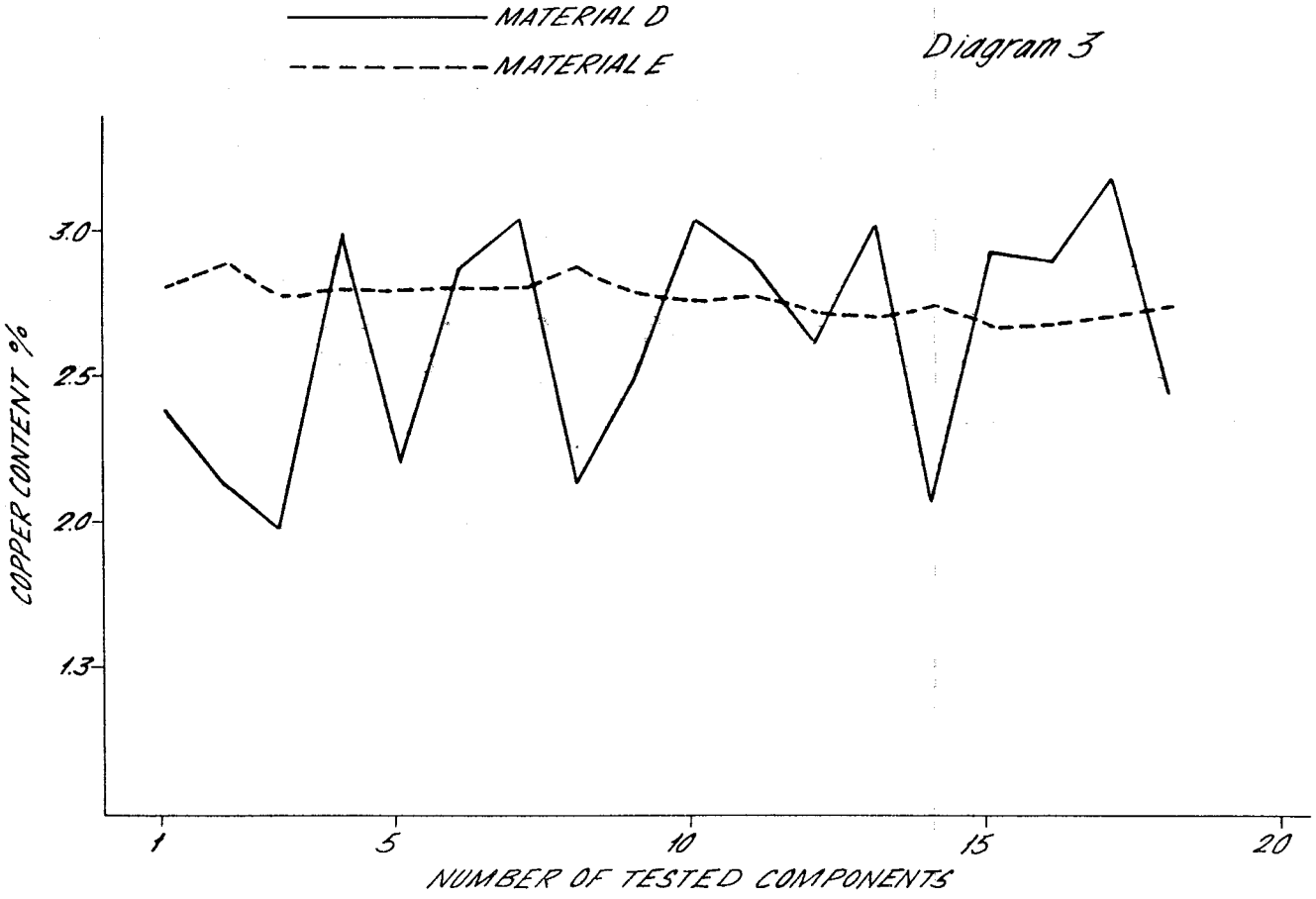
Diagram 3
MATERIAL D
MATERIAL E
COPPER CONTENT %
3.0
2.5
2.0
1.3
1
5
10
15
20
NUMBER OF TESTED COMPONENTS

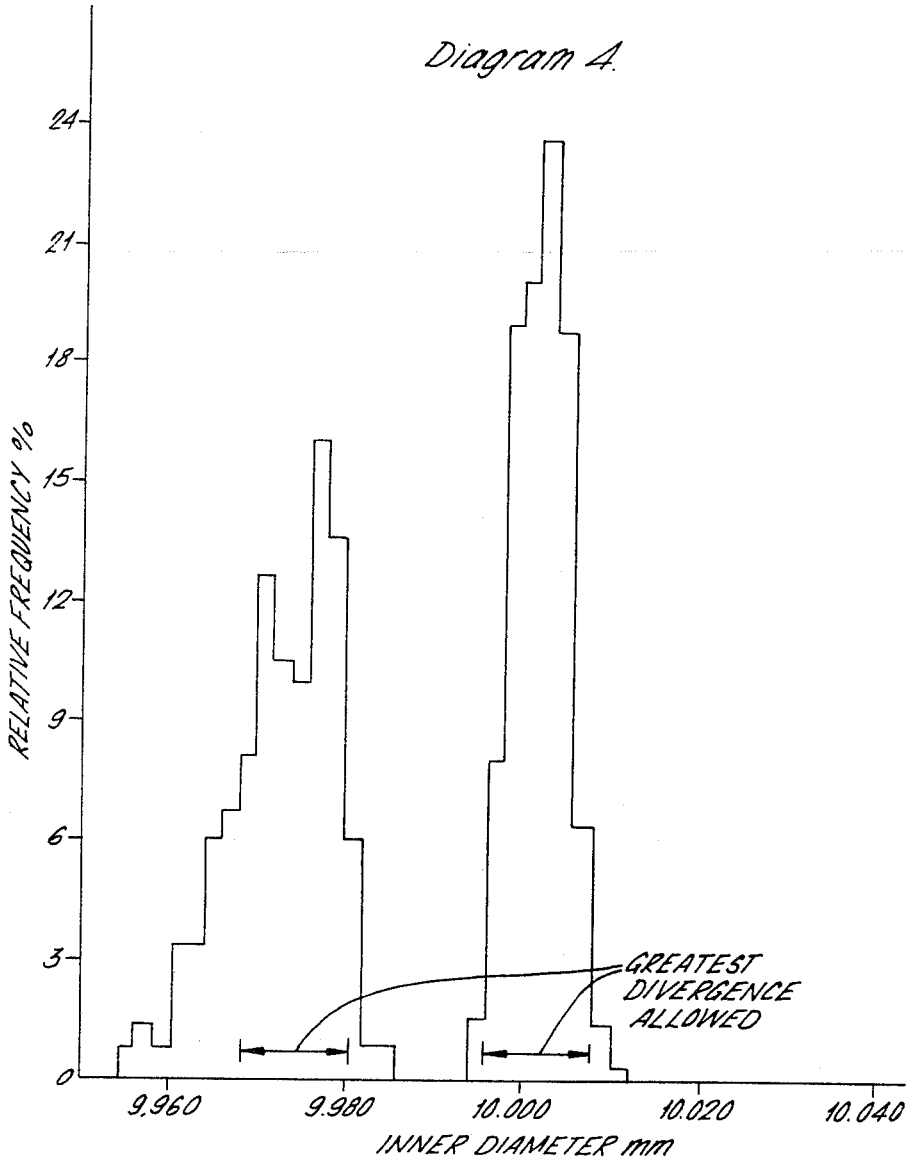
Diagram 4.
RELATIVE FREQUENCY %
24
21
18
15
12
9
6
3
0
GREATEST DIVERGENCE ALLOWED
9.960
9.980
10.000
10.020
10.040
INNER DIAMETER mm

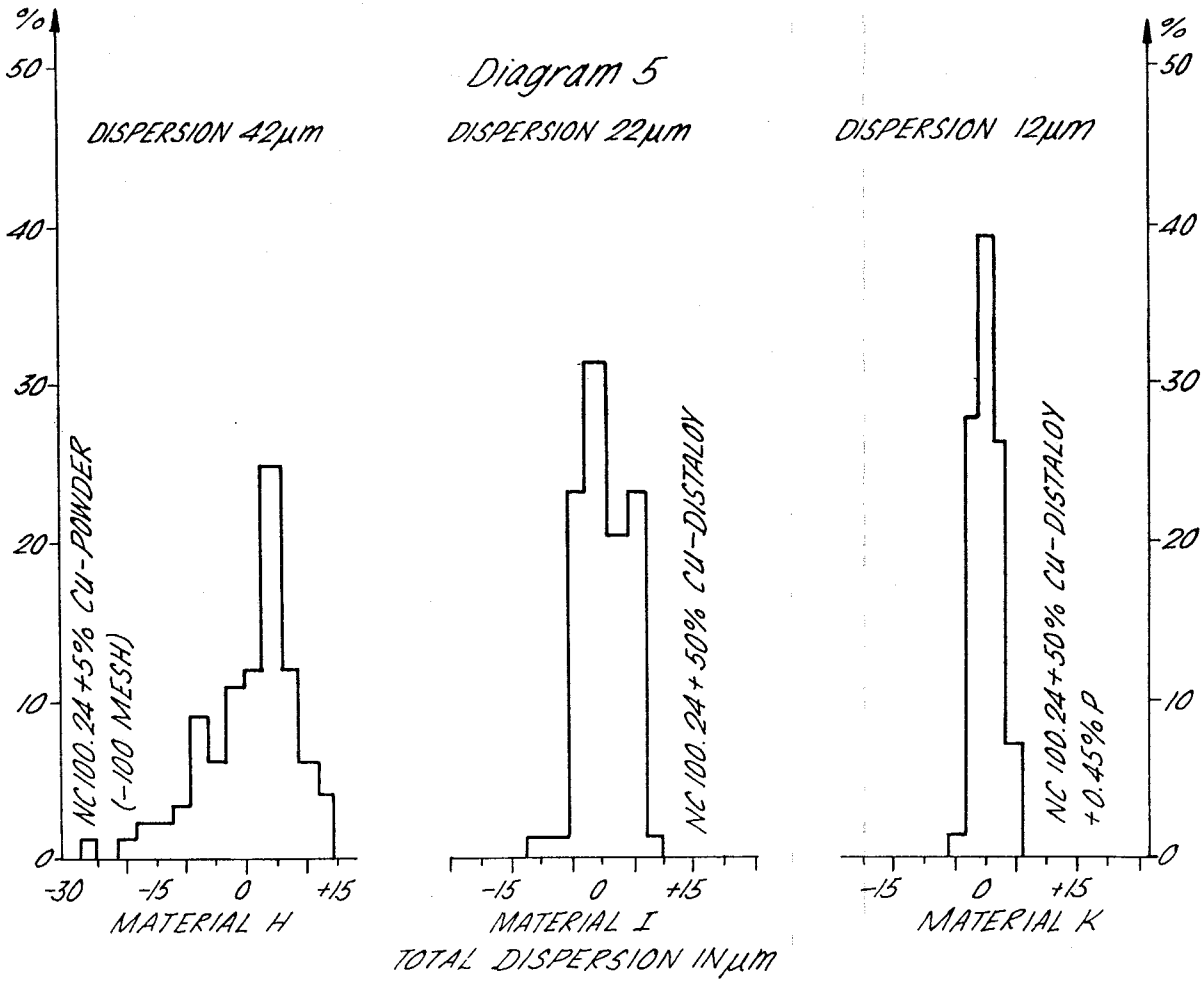
Diagram 5
DISPERSION 42µm
DISPERSION 22µm
DISPERSION 12µm
%
50
40
30
20
10
0
NC100.24+5% CU-POWDER
(-100 MESH)
NC 100.24+50% CU-DISTALOY
NC 100.24+50% CU-DISTALOY
+0.45% P
-30
-15
0
+15
MATERIAL H
MATERIAL I
MATERIAL K
TOTAL DISPERSION IN µm

PROCESS FOR PREPARING IRON BASED POWDER FOR POWDER METALLURGICAL MANUFACTURING OF PRECISION COMPONENTS

BACKGROUND OF THE INVENTION

The present invention relates to a method of manufacturing steel powder to be used in the manufacturing of precision components by means of powder metallurgy. Powder manufactured according to the invention makes it possible to simplify the manufacturing of such precision components having great demands for dimensional accuracy as well as mechanical strength.

Powder metallurgical manufacturing is characterized by long series production of components having good dimensional accuracy. The manufacturing sequence is started by mixing iron powder with lubricant in order to simplify the following compression operation wherein the iron powder mixture is compressed to a green which closely corresponds to the desired shape of the final component. The green is thereupon heated to a temperature at which the component is by means of sintering provided with its final features with regard to strength, ductility etc.

It is often desirous to give the component more accurate dimensions than obtained by means of the above procedure. This is provided by means of a further compression operation, a calibration, wherein the component is given extremely accurate dimensions.

In order to provide the components manufactured by means of powder metallurgy with the high strength which is often required there is used alloying powder as the starting material. Nowadays there are used substantially two types of such alloying powders, namely powder mixtures and so called atomized powders.

Powder mixtures are prepared by mixing with the iron powder a powder of the alloying element, either in the elementary form or as a compound which is decomposable during the sintering process. The so called atomized steel powders are manufactured by comminuting a steel melt containing the desired alloying elements to a powder.

One of the drawbacks of powder mixtures is the risk of segregation which risk is present because of the fact that powders having different characteristics, for example different particle sizes, are mixed with each other without being mechanically connected. This segregation leads to varying composition of the green compacts manufactured from the powder mixtures which in turn leads to varying dimensional changes during the sintering thereof. Another drawback of powder mixtures is their tendency to dust especially when the alloying element is present in the form of very small particles. Of course, this fact can lead to difficult environment problems.

On the other hand the atomized powder completely lacks the risk of segregation as every powder particle has the desired alloying composition. Also the dust risk is reduced as no alloying element having small particle size is included. On the contrary the pre-alloyed atomized powder has another great drawback, namely the low compressibility thereof which is dependent on the dissolvent annealing effect which the alloying elements have on each powder particles. A high compressibility is essential when there is required a component having high density which is a prerequisite for high strength. On the other hand the compressibility of a powder mixture is substantially the same as the compressibility of the iron powder included therein. This fact together with the flexibility with regard to the alloying composition which characterizes powder mixtures have made powder mixtures to the most commonly used form of alloying powder.

SUMMARY OF THE INVENTION

The present invention which relates to an iron based powder has combined the good characteristics of high compressibility with low risk of segregation and dusting in the same powder. Furthermore this powder has proved to give a quite superiour dimensional stability of the components. Quite unexpectedly it has proved that in connection with certain applications it has been possible to dispose of the calibration operation by substitute a powder according to the present invention for an iron-copper mixture.

The invention which is characterized more in detail in the following claims is substantially based on two discoveries, namely the fact that it is possible to adhere copper particles to the surface of the iron particles by diffusion by means of heating a mixture of iron and copper powder (this diffusion taking place without further change of the iron particles) and the fact that a mixture processed in this way, in the following called diffusion alloyed iron powder, morphologically is similar to the non-alloyed iron powder to such a degree that a mixture of the two powders does not segregate. Instead of copper powder it is of course possible to use powder of an easily reducible copper compound, preferably copper oxide, as the diffusion heating takes place in reducing atmosphere.

The manufacturing of diffusion alloyed iron powder is provided according to the invention in the following way: Iron powder having a particle size less than 350 μm, preferably less than 175 μm and most preferably less than 150 μm is mixed with a powder of copper or easily reducible copper compounds having a particle size less than 175 μm, preferably less than 75 μm. The powder mixture is thereupon subjected to a heat treatment at 700°–950° C., preferably 750°–850° C. for a period of 15 minutes to 10 hours, preferably 0.5–5 hours in a reducing atmosphere, the copper particles thereby sintering to the iron particles without providing a diffusion of the copper to such a degree that the lowering of the compressibility connected with the diffusion is greater than 0.15 g/cm$^2$ (ASTM Standard B 331–64). The heat treatment is conducted so that the total oxygen content of the powder is less than 1.2%, preferably less than 0.8%. The cake thus created is crushed to a powder having a maximum particle size less than 350 μm, preferably less than 175 μm and most preferably less than 150 μm. The powder thus obtained is in the following called the diffusion alloyed iron powder.

The iron powder diffusion alloyed with copper is thereupon mixed with pure iron powder in order to provide a mixture having the desired copper content. When using the above powder in connection with powder metallurgy it is suitable to add in addition to the iron powder 0–2%, preferably 0–1%, graphite, 0–2%, preferably 0–1%, solid lubricant in powder form and, if desired, separately or in combination 0–5% nickel, 0–2% Mo and 0–1.5% P. The copper content preferred according to the invention in the primary mixture which is then diffusion annealed is between 1 and 20%, preferably between 5 and 15%, and most preferably between 8 and 12%, while the copper content of the final mixture is between 1 and 5%.

It is possible further to improve the dimensional stability by alloying a powder manufactured according to the above method with phosphorous. The surprising effect thereby obtained is a reduction of the absolute value of the dimensional changes as well as a reduced disperion of the absolute value.

The manufacturing of powders alloyed with phosphorus is conducted in the following way: The iron powder diffusion alloyed with copper is mixed with pure iron powder for providing the mixture with the desired copper content whereupon the phosphorus is added in the form of ferrophosphorus to the desired phosphorus content. According to the invention a phosphorus content of up to 1.5 weight-%, preferably 0.15–1.0 weight-%, is preferred.

The iron powder used as the basic powder shall have a large specific surface in order to provide for an effective adhesion. Therefore, iron powder manufactured from iron sponge, so called sponge powder, is preferred when manufacturing the powder according to the invention.

FIG. 2 (Diagram 1) is a plot of the relative frequency of dimensional change for sintered mixtures D and E;

FIG. 3 (Diagram 2) is a plot showing the dispersion of the dimensional change of materials D and E indicated by standard deviation in μm with the number of pressed components;

FIG. 4 (Diagram 3) is a plot of the variation in copper content of components made from materials D and E; and FIG. 5 (Diagram 4) is a plot of the relative frequency of the diameter measures for components made of materials F and G.

Figure 1:
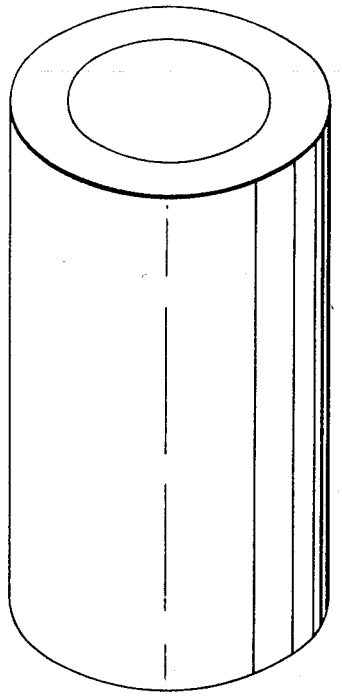
FIG. 1 is a perspective view of a precision component made according to the invention.

The invention is examplified in the following and in connection therewith experiments which have been made with powder according to the invention are described together with the surprising results which the experiments have given.

EXAMPLE 1

A mixture called A was prepared in the following way. First 500 kg copper powder having a maximum particle size of 147 μm was mixed with 4500 kg iron sponge powder having a maximum particle size of 147 μm and 0.015% fluent mineral oil. The compressibility of this mixture was tested according to ASTM Standard B 331-64 giving a compressibility value of 6.59 g/cm$^3$. The mixture a dew point of +22° C. Thereby, there was formed a sintered cake which was ground to a powder having a maximum particle size of 147 μm. This powder substantially consisted of iron powder particles on the surfaces of which copper particles were sintered. The compressibility of this powder was tested according to ASTM Standard B 331-64 giving a value of 6.57 g/cm$^3$, the total oxygen content of the powder was measured to 0.53%, while the full volume weight according to ASTM Standard B 212-48 was found to be 2.43 g/cm$^3$.

300 kg of the powder prepared as above was mixed with 700 kg iron sponge powder and 8 kg zink stearate powder. The mixture thus prepared is called B in the following.

A mixture C comprising the following components was prepared:

96.2% iron spong powder having a maximum particle size of 147 μm, 3.0% copper powder having a maximum particle size of 147 μm, 0.8% zinc stearate powder.

Two kilograms of each of the mixtures B and C were filled into a hopper and were thereupon allowed unobstructedly to flow out. The last tenth of each of the mixtures was collected and analysed with respect to copper. The copper content of the mixture B was found to be 2.8% Cu and the copper content of the mixture C was found to be 0.9% Cu.

From the two mixtures tensile test bars were pressed at a pressure of 600 MPa. The tensile test bars were sintered at 1120° C. for 30 minutes in an atmosphere of cracked ammonia. The characteristics of the test bars were measured, giving the following results:

| | B | C |
|---|---|---|
| Sintered density g/cm$^3$ | 6,71 | 6,73 |
| Dimensional change % | +0,59 | +0,59 |
| Tensile strength N/mm$^2$ | 320 | 298 |
| Elongation at rupture % | 5,8 | 6,6 |

The results of the two experiments described above show that the risk of demixing can be substantially decreased while maintaining good mechanical characteristics of the material by using the metal powder manufactured according to the invention.

EXAMPLE 2

Two powder mixtures D and E having a composition according to the following table were prepared.

Mixture D:

96.2% iron sponge powder having a maximum particle size of 147 μm 3.0% copper powder having a maximum particle size of 147 μm 0.8% zinc stearate Mixture E:

69.2% iron sponge powder having a maximum particle size of 147 μm 30.0% diffusion alloyed iron powder comprising 10.0% copper and having a maximum particle size of 147 μm 0.8% zinc stearate.

An experiment was conducted in manufacturing sintered components in full scale production, wherein each of the mixtures D and E were compressed and sintered in conventional manner giving a number of 10,000 components. The component in question was included in the normal production of the manufacturer thereby manufactured from material according to mixture D. After the sintering a sufficient number of components from statistic point of view was taken out and the dimensional changes of these components were measured. For mixture D a dimensional change range of between 0.43 and 0.74% was measured while the same range for mixture E was between 0.39% and 0.54%. These results appear from diagram 1 wherein the relative frequency of the dimensional change for the mixture D and E has been drawn. Also the standard deviation of the dimensional change of components continuously taken out during the production was calculated. The result presented in diagram 2 shows that the dispersion of the dimensional change is substantially less for the material E than for the material D. In turn this fact means that the fixed requirements for dimensional accuracy, that is the defined measure tolerances, can be easier provided when using the material E. The measure accuracy obtained with material E according to the above experiments corresponds to the standard tolerance grade IT 8, while the components manufactured from material D provided for a measure accuracy corresponding to the standard tolerance grade IT 10.

Additionally there was randomly taken out a number of sintered components manufactured from each of the materials D and E. These components were analysed with regard to the copper content. For the material D the copper contents were between 3.17% and 1.97%, while the corresponding contents for material E were 2.88% and 2.66%, that is the copper content range for material D was 1.20% and for material E 0.22%. These figures are shown in diagram 3. Additionally the mean value (x) and the standard deviation ($\pm\delta$) for the analysis results thus obtained were calculated. These values appear from the following table.

| Material | $\bar{x}$ | $\pm\delta$ |
|---|---|---|
| D | 2,62% | 0,40% |
| E | 2,76% | 0,06% |

The above results obviously show that the dispersion of the copper content within a production series is substantially less when the components have been manufactured from material E than when the components have been manufactured from material D.

EXAMPLE 3

Two powder mixtures F and G were prepared. The composition appears from the following table.

Mixture F:

97.2% iron sponge powder having a maximum particle size of 147 μm 2.0% copper powder having a maximum particle size of 74 μm 0.8% zinc stearate.

Mixture G:

79.2% iron sponge powder having a maximum particle size of 147 μm 20.0% diffusion alloyed iron powder comprising 10.0% copper having a maximum particle size of 147 μm 0.8% zinc stearate.

From each material F and G there were manufactured in industrial scale at a sintered components manufacturer 100,000 bearing bushings (according to FIG. 1) by pressing and sintering. The compound in question was included in the normal manufacturing of the manufacturer and was manufactured from a material according to mixture F. A number of complete components which were sufficient from statistical point of view (according to ISO/TC 119) were tested with regard to dimensional stability. For bearing bushings manufactured from material F the inner diameter was measured to be between 9,954 mm and 9,986 mm, while corresponding measures for the components manufactured from material G were 9.994 mm and 10.012 mm. Thus, the dispersion value was 0.032 and 0.018 mm, respectively, which corresponds to the standard tolerance grades IT 9 and IT 7, respectively, for components manufactured from the materials F and G, respectively. In diagram 4 the relative frequency of the diameter measures is given for components manufactured from the materials F and G, respectively. In the diagram there has also been included the defined tolerance requirement which is the same as the measures obtained after a calibration compression.

Additionally there was obtained a substantially less ovality measured as the difference between the maximum and minimum measures of the diameters for the components manufactured from the material G. For the details manufactured from this material the ovality was measured to 0.0039 mm while the same measure for the details manufactured from the material F was 0.0139 mm. The same effect was obtained with regard to the conicity of the components defined as the difference between the end diameters of the bearing bushings. For components of the material F the conicity was 0.0327 mm and for G the conicity was 0.0061 mm.

Example 4

Three powder mixtures, H, I and K having the following compositions were prepared:

Mixture H: 94.2% iron sponge powder having a maximum particle size of 147 μm, 5.0% copper powder having a maximum particle size of 147 μm, 0.8% zinc stearate powder.

Mixture I:

49.2% iron sponge powder having a maximum particle size of 147 μm, 50.0% diffusion alloyed iron powder containing 10.0% copper and having a maximum particle size of 147 μm, 0.8% zinc stearate powder.

Mixture K:

46.2% iron sponge powder having a maximum particle size of 147 μm, 50.0% diffusion alloyed iron powder containing 10.0% copper and having a maximum particle size of 147 μm, 3.0% ferrophosphorus containing 15% phosphorus and having a maximum particle size of 44 μm, 0.8% zinc stearate powder.

From each mixture there were pressed 2500 rectangular bars having the dimensions 10×10×30 mm in an automatic press manufactured by Dorst. Thereupon the components were sintered in a belt furnace for 30 minutes at 1120° C. in an endogene gas atmosphere. After the sintering a number of components which was sufficient from a statistical point of view was taken out, the dimensional stability of said components being determined. For mixture H there was obtained a total dispersion value of 42 μm, for mixture I there was obtained a total dispersion value of 22 μm and for mixture K there was obtained a total dispersion value of 12 μm. Thus, the result is that the dispersion of the dimensional changes is substantially less for material K than for materials H and I. The result is also shown in diagram 5.

This in turn means that the predetermined requirements as to dimensional stability, i.e. the predetermined dimensional tolerances, are easier to reach when using the material K. The dimensional accuracy obtained by means of material K according to the above experiments corresponds to the standard tolerance grade IT 6 while components manufactured from material H reached a dimensional accuracy corresponding to the standard tolerance grade IT 9 and components manufactured from material I reached a dimensional accurace corresponding to the standard tolerance grade IT 7. The components having a dimensional accuracy corresponding to the standard tolerance grade IT 6 have a tolerance which is better than a well calibrated tolerance, that is a tolerance reached after a further pressing operation after sintering.

Example 5

Six powder mixtures, N a, b; O a, b; P a, b having a composition according to the following table were prepared:

Mixture Na:
93.75% Fe
5.0% Cu as Cu-powder
0.45% P
0.8% zinc stearate

Mixture Oa:
93.65% Fe
5.0% Cu as Cu-powder
0.45% P
0.4% C
0.5% zinc stearate

Mixture Pa:
94.10% Fe
5.0% Cu as Cu-powder
0.4% C
0.5% zinc stearate

Mixture Nb:
93.75% Fe
5.0% Cu as Cu-Distaloy containing 10% Cu
0.45% P
0.8% zinc stearate Mixture Ob:
93.65% Fe
5.0% Cu as Cu-Distaloy containing 10% Cu
0.45% P
0.4% C
0.5% zinc stearate Mixture Pb:
94.10% Fe
5.0% Cu as Cu-Distaloy containing 10% Cu
0.4% C
0.5% zinc stearate From the six mixtures there were pressed test bars at a pressure of 590 MPa. The test bars were sintered at 1120° C. for 30 minutes in an endogenous atmosphere having a suitable carbon potential. The mechanical properties of the test bars were determined giving the following results:

| Material | Sintered density g/cm$^3$ | Dimensional change % | Hardness | Tensile strength B N/mm$^2$ | Elongation at rupture % |
|---|---|---|---|---|---|
| Na | 6.8 | +0.28 | 120 | 410 | 3.5 |
| Oa | 6.7 | +0.15 | 155 | 605 | 2.0 |
| Pa | 6.7 | +0.56 | 105 | 305 | 4.5 |
| Nb | 6.8 | +0.26 | 120 | 410 | 3.0 |
| Ob | 6.7 | +0.15 | 150 | 600 | 2.0 |
| Pb | 6.7 | +0.52 | 110 | 310 | 4.5 |

From the results appear that the strength obtained when copper powder is mixed with iron powder is not influenced when the copper powder is replaced by an iron powder diffusion alloyed with copper. Components manufactured from an iron powder diffusion alloyed with copper obtain a good strength especially when it is alloyed with carbon and phosphorus while the dimensional tolerances which are obtained hitherto only have been reachable by means of a further manufacturing step after the sintering.

I claim:

1. A process for manufacturing iron based powder to be used for powder metallurgical manufacturing of precision components having good accuracy to size and high strength, wherein a mixture of substantially only iron powder and an alloying powder selected from the group consisting of copper, reducible copper compounds and mixtures thereof is prepared, the mixture is subjected to an annealing treatment in reducing atmosphere at a temperature between 700° C. and 950° C. for a period of 15 minutes to 10 hours, preferably 0.5–5 hours, so that said alloying powder is adhered to said iron powder by diffusion, the cake thus obtained is ground to an iron powder diffusion alloyed with copper, and the copper alloyed iron powder thus obtained is mixed with pure iron powder in such an amount that the mixture obtains the intended copper content.

2. A process as claimed in claim 1, wherein said iron powder has a maximum particle size of 350 μm and said powder of copper and/or reducible copper compounds has a maximum particle size of 175 μm.

3. A process as claimed in claim 1, wherein said iron powder is mixed with 1–20% of said powder of copper and/or reducible copper compounds.

4. A process as claimed in claim 1, wherein the cake obtained at said annealing treatment is ground to a powder having a maximum particle size of 350 μm.

5. A process as claimed in claim 1, wherein said annealing treatment is provided under such conditions with regard to time and temperature that the compressibility of the annealed powder according to ASTM Standard B 331-64 is at most 0.15 g/cm$^3$ less than the compressibility of a corresponding mixture of iron and copper powder and that the total oxygen content does not exceed 1.2%.

6. A process as claimed in claim 1, wherein the copper alloyed iron powder is mixed with 0–2% graphite, 0–2% solid lubricant in powder form and separately or in combination 0–5% Ni, 0–2% Mo, and 0–1.5% P.

7. A process as claimed in claim 1, wherein said iron powder is mixed with 5–15% of the alloying powder.

8. A process as claimed in claim 1, wherein said iron powder has a maximum particle size of 175 μm, preferably 150 μm, said powder of copper and/or reducible copper compounds has a maximum particle size of 75 μm and the cake obtaind by said annealing is ground to a powder having a maximum size of 175 μm, preferably 150 μm.

9. A process as claimed in claim 1, wherein up to 1.5%, preferably 0.15–1.0%, phosphorus is added as an alloying component.

* * * * *

UNITED STATES PATENT AND TRADEMARK OFFICE

CERTIFICATE OF CORRECTION

PATENT NO. : 4,238,221

DATED : December 9, 1980

INVENTOR(S) : Lars-Erik Svensson

It is certified that error appears in the above-identified patent and that said Letters Patent are hereby corrected as shown below:

Inventors' name : Lars-Erik Svensson

Signed and Sealed this

*Thirty-first* Day of *March 1981*

[SEAL]

*Attest:*

RENE D. TEGTMEYER

*Attesting Officer*

*Acting Commissioner of Patents and Trademarks*